US011681242B2

(12) United States Patent
Igawa et al.

(10) Patent No.: US 11,681,242 B2
(45) Date of Patent: Jun. 20, 2023

(54) DEVELOPING DEVICE AND IMAGE FORMING APPARATUS HAVING A REVERSE HELICAL SECTION

(71) Applicant: FUJIFILM Business Innovation Corp., Tokyo (JP)

(72) Inventors: Shota Igawa, Kanagawa (JP); Masanori Kato, Kanagawa (JP); Katsumi Yamada, Kanagawa (JP); Yoshihisa Nakao, Kanagawa (JP); Atsushi Funada, Kanagawa (JP); Mitsutoshi Hongo, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/407,270

(22) Filed: Aug. 20, 2021

(65) Prior Publication Data

US 2022/0373930 A1 Nov. 24, 2022

(30) Foreign Application Priority Data

May 20, 2021 (JP) ..... JP2021-085637

(51) Int. Cl.
*G03G 15/08* (2006.01)

(52) U.S. Cl.
CPC ..... *G03G 15/0891* (2013.01); *G03G 15/0844* (2013.01); *G03G 15/0893* (2013.01); *G03G 2215/083* (2013.01); *G03G 2215/0822* (2013.01)

(58) Field of Classification Search
CPC ..... G03G 15/0891; G03G 15/0893; G03G 15/0844; G03G 2215/0819; G03G 2215/0822; G03G 2215/083; G03G 2215/0827; G03G 2215/0838
See application file for complete search history.

(56) References Cited

U.S. PATENT DOCUMENTS

| | | | | |
|---|---|---|---|---|
| 2008/0187332 | A1* | 8/2008 | Tsuda | G03G 15/0898 399/254 |
| 2012/0189349 | A1* | 7/2012 | Okuno | G03G 15/0189 399/254 |
| 2017/0068185 | A1* | 3/2017 | Suenami | G03G 15/0893 |
| 2018/0231916 | A1* | 8/2018 | Matsushima | G03G 15/0889 |
| 2022/0373931 | A1* | 11/2022 | Yamada | G03G 15/0844 |

FOREIGN PATENT DOCUMENTS

JP 2009-175768 A 8/2009

* cited by examiner

*Primary Examiner* — Arlene Heredia
*Assistant Examiner* — Laura Roth
(74) *Attorney, Agent, or Firm* — Sughrue Mion, PLLC

(57) ABSTRACT

A developing device includes: a first transport member and a second transport member that are disposed in a first transport path and a second transport path provided at an upper side and a lower side in a gravitational direction and that transport a developer. The developing device also includes an ejecting path that is provided in the first transport path disposed at the upper side in the gravitational direction and that ejects an excess developer. The developing device includes a reverse helical section that is disposed in front of a support that supports the second transport member. The reverse helical section helically extends in a reverse direction relative to a helical section provided for circulating the developer, the developer being transported to the ejecting path by the reverse helical section.

9 Claims, 4 Drawing Sheets

DEVELOPING DEVICE AND IMAGE FORMING APPARATUS HAVING A REVERSE HELICAL SECTION

CROSS-REFERENCE TO RELATED APPLICATIONS

This application is based on and claims priority under 35 USC 119 from Japanese Patent Application No. 2021-085637 filed May 20, 2021.

BACKGROUND

(i) Technical Field

The present disclosure relates to developing devices and image forming apparatuses.

(ii) Related Art

Japanese Unexamined Patent Application Publication No. 2009-175768 discloses a developing device that includes a development container, a first agitation member, a second agitation member, and a communication path. The development container has a developing roller that transports a toner to a developing region where an electrostatic latent image is to be developed into a toner image, a developing-roller container that accommodates the developing roller, a first agitation chamber disposed diagonally below the developing-roller container, and a second agitation chamber disposed adjacent to the developing-roller container and above the first agitation chamber. The first agitation member is accommodated in the first agitation chamber and transports the toner in the first agitation chamber in a predetermined first transport direction while agitating the toner. The second agitation member is accommodated in the second agitation chamber and transports the toner in the second agitation chamber in a second transport direction opposite of the first transport direction while agitating the toner. The communication path allows a downstream end of the first agitation chamber in the first transport direction and an upstream end of the second agitation chamber in the second transport direction to communicate with each other so as to transport the toner from the downstream end of the first agitation chamber in the first transport direction toward the upstream end of the second agitation chamber in the second transport direction. In the communication path, a section thereof that is located away from the developing roller relative to a rotation shaft of the first agitation member and that is located closest to the developing roller in a surface of the communication path in contact with the second agitation chamber is provided vertically below the rotation axis of the developing roller.

SUMMARY

Aspects of non-limiting embodiments of the present disclosure relate to a developing device and an image forming apparatus in which, in a developing device including a first transport member and a second transport member that are disposed in a first transport path and a second transport path provided at an upper side and a lower side in a gravitational direction and that transport a developer so as to cause the developer to circulate between the first transport path and the second transport path, and also including an ejecting mechanism that ejects an excess developer to the first transport path disposed at the upper side in the gravitational direction, the developer is prevented from being transported to a support that supports the second transport member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including: a first transport member and a second transport member that are disposed in a first transport path and a second transport path provided at an upper side and a lower side in a gravitational direction and that transport a developer so as to cause the developer to circulate between the first transport path and the second transport path; an ejecting mechanism that is provided in the first transport path disposed at the upper side in the gravitational direction and that ejects an excess developer; and a reverse helical section that is disposed in front of a support that supports the second transport member disposed at the lower side in the gravitational direction, the reverse helical section helically extending in a reverse direction relative to a helical section provided for circulating the developer, wherein the developer is transported to the ejecting mechanism by the reverse helical section.

BRIEF DESCRIPTION OF THE DRAWINGS

Exemplary embodiments of the present disclosure will be described in detail based on the following figures, wherein.

DETAILED DESCRIPTION

Figure 1:
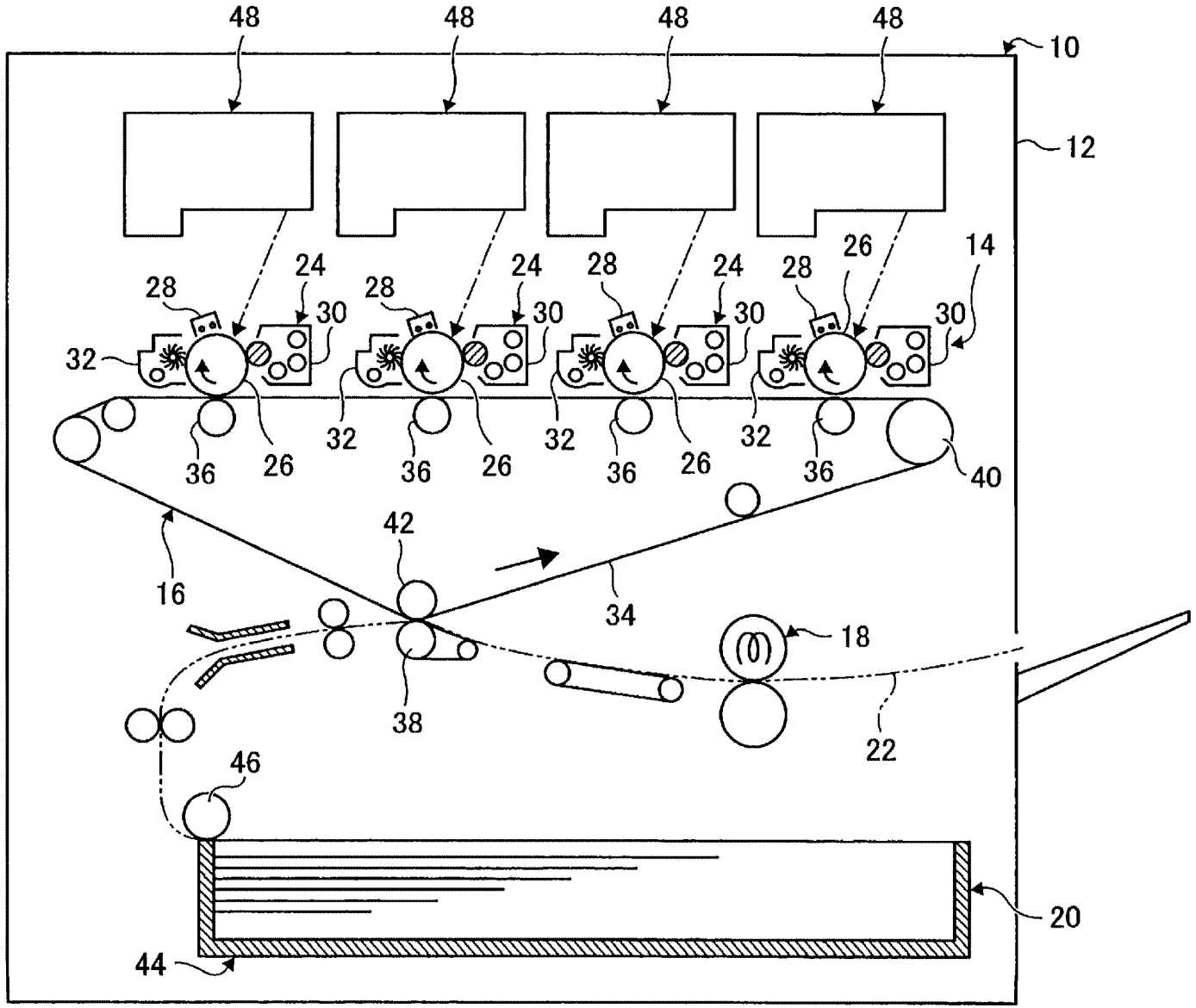
FIG. 1 is a side view illustrating the configuration of an image forming apparatus according to an exemplary embodiment of the present disclosure.

Exemplary embodiments of the present disclosure will now be described with reference to the drawings. FIG. 1 illustrates an image forming apparatus 10 according to an exemplary embodiment of the present disclosure. The image forming apparatus 10 has an image forming apparatus body 12. The image forming apparatus body 12 contains an image forming section 14, a transfer device 16, a fixing device 18, and a sheet feeding device 20. The image forming apparatus body 12 also has a transport path 22 therein for transporting a recording medium, such as a sheet.

The image forming section 14 employs an electrophotographic method to form an image onto the recording medium. The image forming section 14 has multiple image forming units 24, such as four image forming units 24. The four image forming units 24 form toner images of different colors, such as yellow, magenta, cyan, and black colors.

Each image forming unit 24 has a photoconductor drum 26. The photoconductor drum 26 is an example of an image bearing member that rotates while retaining, on the outer peripheral surface thereof, a corresponding toner image to be transferred onto the recording medium. The image forming unit 24 is also provided with a charging device 28 that electrostatically charges the photoconductor drum 26, a developing device 30 that develops an electrostatically-charged latent image by using toner, and a cleaning device 32 that cleans the photoconductor drum 26 after a transfer process. The image forming unit 24 is further provided with an optical writing device 48 that forms a latent image on the electrostatically-charged photoconductor drum 26.

The transfer device 16 has an intermediate transfer belt 34. The intermediate transfer belt 34 receives toner images first-transferred thereto by first transfer members 36 from the respective photoconductor drums 26. The first-transferred toner images are then second-transferred onto the recording medium by a second transfer member 38.

The intermediate transfer belt 34 is supported in a rotatable manner by multiple support members 40. Moreover, a backup member 42 is provided facing the second transfer member 38.

The fixing device 18 fixes the toner images transferred on the recording medium onto the recording medium by using, for example, heat and pressure.

The sheet feeding device 20 has a container 44 that contains a stack of recording media, and also has a delivery member 46 that delivers each recording medium contained in the container 44 toward the transport path 22.

The transport path 22 is used for transporting the recording medium from the sheet feeding device 20 to an area between the second transfer member 38 and the backup member 42, further transporting the recording medium to the fixing device 18, and then transporting the recording medium so as to eject the recording medium outside the image forming apparatus body 12.

In the image forming apparatus 10 having the above-described configuration, the toner images formed on the outer peripheral surfaces of the respective photoconductor drums 26 are first-transferred onto the intermediate transfer belt 34, the toner images first-transferred on the intermediate transfer belt 34 are second-transferred onto the recording medium, and the toner images second-transferred on the recording medium are fixed onto the recording medium by the fixing device 18.

Figure 2:
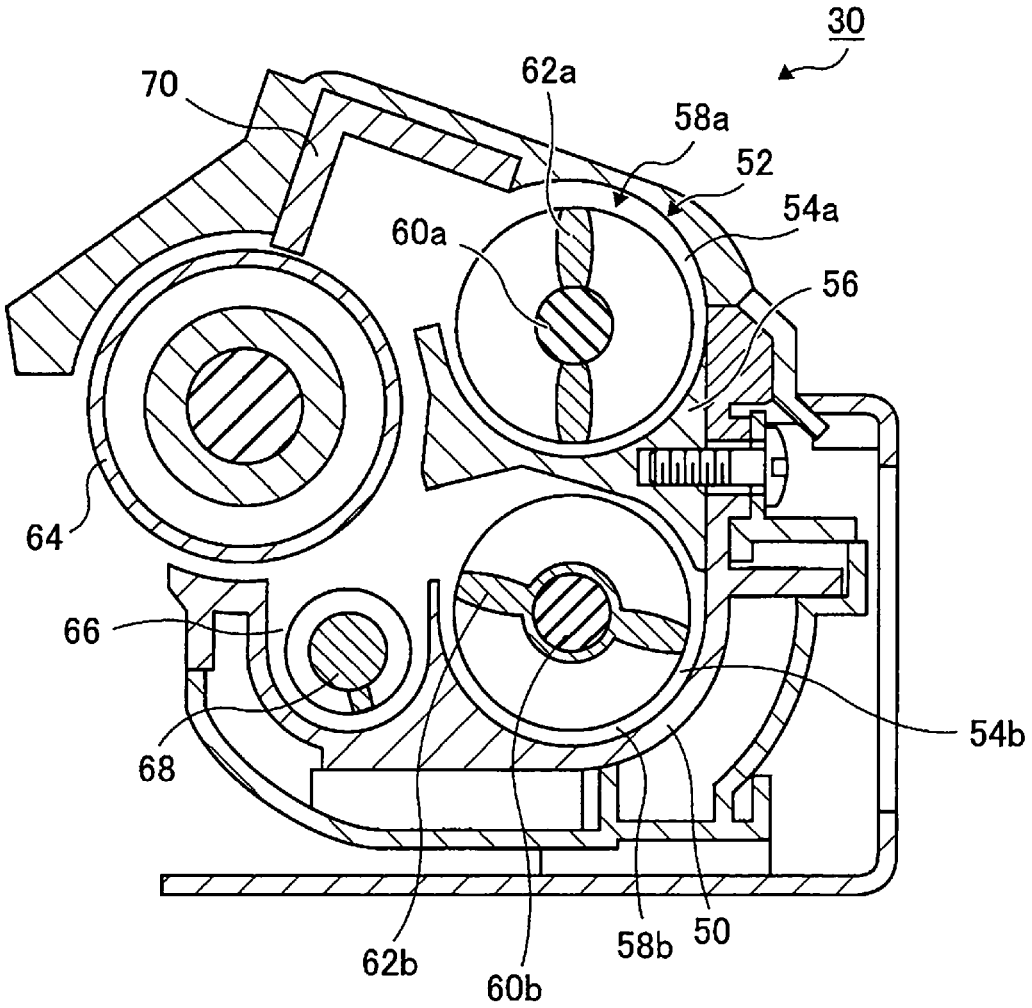
FIG. 2 is a cross-sectional view illustrating a developing device according to an exemplary embodiment of the present disclosure.
Figure 3:
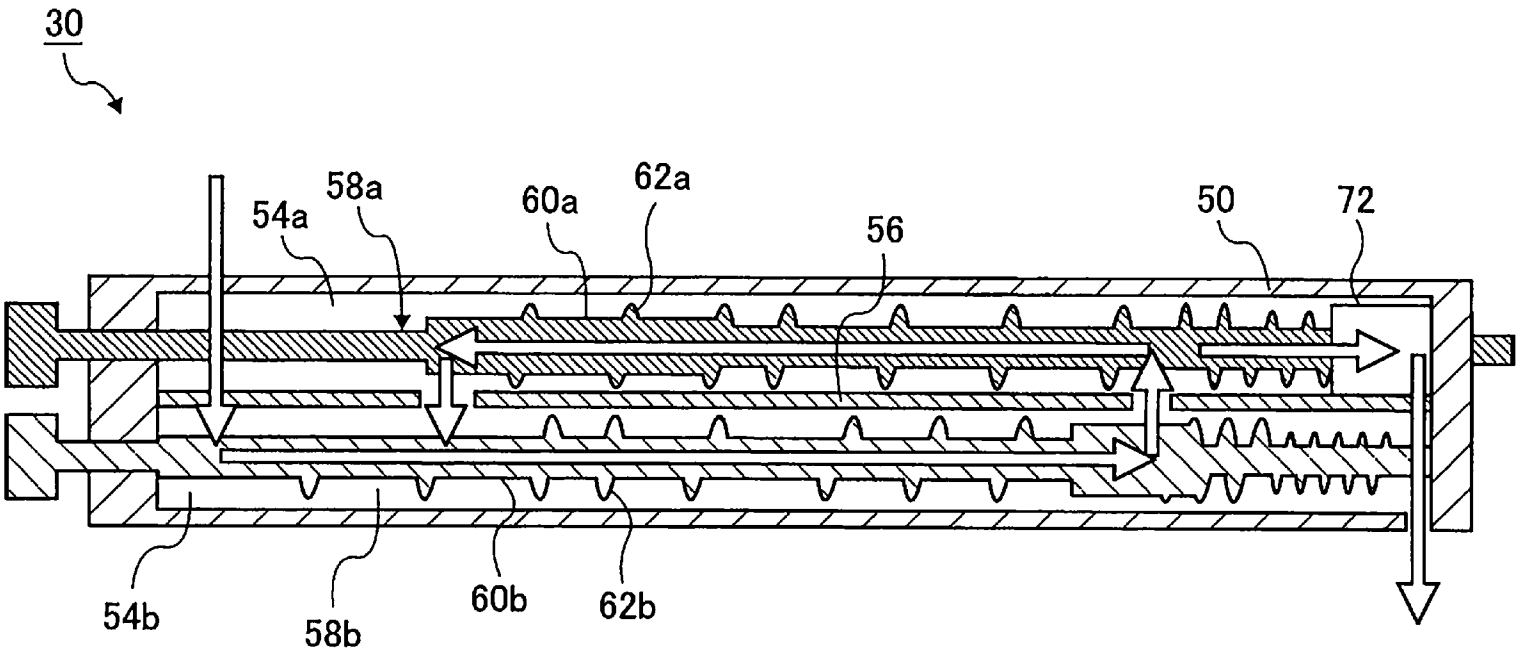
FIG. 3 is a cross-sectional view schematically illustrating the flow of a developer in the developing device according to the exemplary embodiment of the present disclosure.
Figure 4:
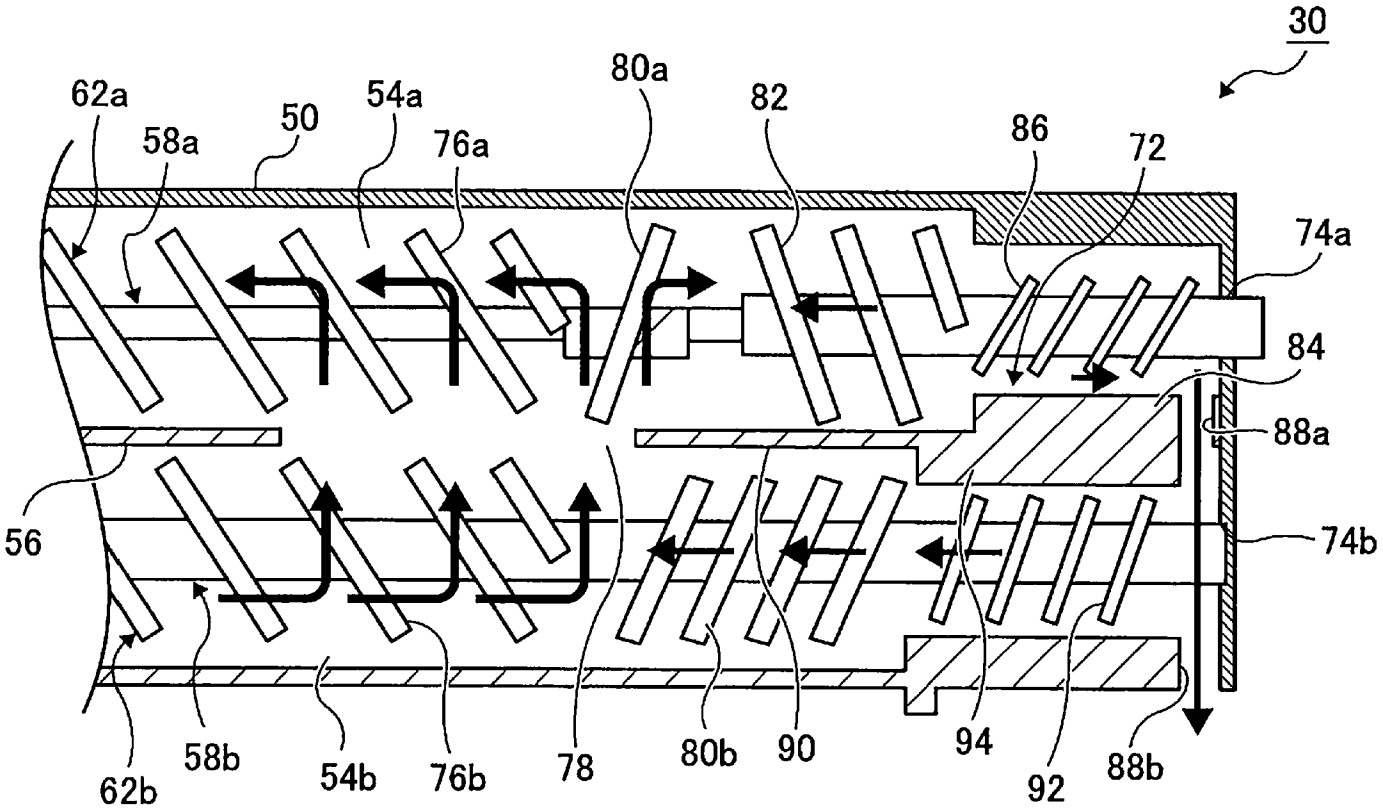
FIG. 4 schematically illustrates an area surrounding an ejecting mechanism that ejects an excess developer in the developing device according to the exemplary embodiment of the present disclosure.

FIGS. 2 to 4 illustrate each developing device 30.

The developing device 30 is a two-component developing device that performs a developing process by agitating a developer containing a carrier and a toner and electrostatically charging the toner.

The developing device 30 has a developing device body 50. The developing device body 50 is provided with a developer transport section 52 therein. For example, the developer transport section 52 has two transport paths 54*a* and 54*b* that extend in the longitudinal direction of the developing device body 50 and that lie one on top of the other in the gravitational direction. The transport path 54*a* located at the upper side will be defined as a first transport path, whereas the transport path 54*b* located at the lower side will be defined as a second transport path. The transport paths 54*a* and 54*b* are separated from each other in the vertical direction by a partition wall 56. The partition wall 56 has a cross-sectionally circular-arc-shaped upper surface that serves as the lower surface of the first transport path 54*a*. The partition wall 56 also has a cross-sectionally circular-arc-shaped lower surface that serves as the upper surface of the second transport path 54*b*.

The first transport path 54*a* has a first transport member 58*a* disposed therein, and the second transport path 54*b* has a second transport member 58*b* disposed therein. The transport members 58*a* and 58*b* are respectively constituted of rotation shafts 60*a* and 60*b* and helical transport sections 62*a* and 62*b* provided around the rotation shafts 60*a* and 60*b*.

In the developing device body 50, a developing roller 64 is provided alongside the first transport path 54*a*. The developing roller 64 faces the aforementioned photoconductor drum 26 and is configured to move the toner adhered to a magnetic brush provided around the developing roller 64 onto a latent image formed on the photoconductor drum 26. Furthermore, a third transport path 66 is provided below the developing roller 64 in the developing device body 50. The third transport path 66 is provided with a third transport member 68. A thickness regulation member 70 is provided above the developing roller 64 and is configured to regulate the thickness of the developer.

As shown in FIG. 3, in the above-described configuration, the developer is first supplied to one end of the second transport path 54*b*, is supplied to the first transport path 54*a* by the second transport member 58*b* via near the other end of the second transport path 54*b*, is transported to near one end of the first transport path 54*a* by the first transport member 58*a*, so as to circulate between the first transport path 54*a* and the second transport path 54*b*. The first transport member 58*a* rotates clockwise in FIG. 2 so as to transport the developer from the first transport path 54*a* to the developing roller 64, thereby moving the toner adhered to the magnetic brush provided around the developing roller 64 that rotates counterclockwise onto the latent image formed on the photoconductor drum 26. The developer not supplied for the development by the developing roller 64 moves to the third transport path 66, so as to be returned to the second transport path 54*b* by the third transport member 68 that rotates clockwise. The developer returned to the second transport path 54*b* is transported to the first transport path 54*a* by the second transport member 58*b* that rotates clockwise.

The other end of the first transport path 54*a* is provided with an ejecting mechanism 72. Of the developer circulating between the first transport path 54*a* and the second transport path 54*b*, an excess developer is ejected outside the developing device 30 from the other end of the first transport path 54*a* by the ejecting mechanism 72.

FIG. 4 illustrates the configuration of the ejecting mechanism 72 and the periphery thereof.

The aforementioned rotation shafts 60*a* and 60*b* are rotatably supported by supports 74*a* and 74*b* provided at an end of the developing device body 50.

The aforementioned first transport section 62*a* has a first helical section 76*a*, whereas the second transport section 62*b* has a second helical section 76*b*. The partition wall 56 has a circulation port 78 at the end of the first helical section 76*a* and the second helical section 76*b*. The developer is transported from the second transport path 54*b* to the first transport path 54*a* via the circulation port 78.

The rotation shaft 60*a* is provided with a first reverse helical section 80*a* that faces the end of the first helical section 76*a*. The first reverse helical section 80*a* has, for example, one helical turn in the reverse direction relative to the first helical section 76*a*. A portion of the developer circulated by the first reverse helical section 80*a* is transported toward the ejecting mechanism 72. The non-helical-section side of the first reverse helical section 80*a* is provided with a return helical section 82. The return helical section 82 returns a portion of the developer transported from the first reverse helical section 80*a* toward the first helical section 76*a*.

The ejecting mechanism 72 ejects an excess developer that has traveled over a step 84 provided at the partition wall 56. The rotation shaft 60*a* above the step 84 is provided with an ejection helical section 86 helically extending in the same direction as the first reverse helical section 80*a*, and transports the developer that has traveled over the step 84 to a first ejection port 88*a*. The first ejection port 88*a* is provided in the partition wall 56. The excess developer falls toward the second transport path 54*b* via the first ejection port 88*a*.

The rotation shaft 60*b* is provided with a second reverse helical section 80*b* that faces the end of the aforementioned second helical section 76*b*. The second reverse helical section 80*b* has, for example, multiple helical turns in the reverse direction relative to the second helical section 76*b*. The diameter of the second reverse helical section 80*b* is smaller than the diameter of the second helical section 76*b*. A pressure applier 90 is provided to cover from one end to the other end of the second reverse helical section 80*b*. The pressure applier 90 applies pressure acting toward the second helical section 76*b* to the developer returned by the second reverse helical section 80*b*. Accordingly, the developer transported by the second helical section 76*b* and the developer returned by the second reverse helical section 80*b* merge below the circulation port 78 of the second transport path 54*b*, and the developer is pushed upward to the first transport path 54*a* via the circulation port 78. The upper surface of the pressure applier 90 retains the developer accumulating on the pressure applier 90.

An auxiliary helical section 92 is provided in addition to the second helical section 76*b*. The helical direction of the auxiliary helical section 92 is the same as that of the second reverse helical section 80*b*, and is opposite that of the second helical section 76*b*. The diameter of the auxiliary helical section 92 is smaller than the diameters of the second helical section 76*b* and the second reverse helical section 80*b*. The second helical section 76*b* is surrounded by an extended roof section 94. The cross-sectional area of the extended roof section 94 is smaller than the cross-sectional area of the second transport path 54*b*. Therefore, the amount of developer entering the periphery of the auxiliary helical section 92 decreases. Even when the developer enters this area, the developer is pushed back toward the second reverse helical section 80*b* in accordance with the rotation of the auxiliary helical section 92, thereby preventing the developer from reaching the support 74*b*.

A second ejection port 88*b* is provided at the bottom of the developing device body 50 in correspondence with the aforementioned first ejection port 88*a*. The excess developer is ejected outside the developing device 30 via the second ejection port 88*b*.

Although the excess developer passes through the second transport path 54*b* by traveling around the rotation shaft 60*b* near the support 74*b*, the excess developer passing through the second transport path 54*b* does not receive pressure toward the support 74*b*, thereby preventing the excess developer from reaching the support 74*b*.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a first transport member and a second transport member that are disposed, respectively, in a first transport path and a second transport path provided at an upper side and a lower side in a gravitational direction and that are configured to transport a developer so as to cause the developer to circulate between the first transport path and the second transport path;

an ejecting path that is provided in the first transport path, wherein the ejecting path is disposed at the upper side in the gravitational direction and is configured to eject an excess developer; and a reverse helical section that is disposed on a side of a support that supports the second transport member, the reverse helical section helically extending in a reverse direction relative to a helical section provided for circulating the developer, and the side of the support being upstream from the support in the reverse direction, wherein the reverse helical section is disposed in the second transport path, wherein the reverse helical section is configured to transport the developer to the ejecting path, wherein the developing device further comprises an auxiliary helical section that is provided between the support and the reverse helical section, the auxiliary helical section helically extending in a helical direction identical to that of the reverse helical section, and wherein the auxiliary helical section has a diameter smaller than that of the reverse helical section.

2. The developing device according to claim 1, wherein the reverse helical section has a diameter smaller than that of the helical section.

3. The developing device according to claim 1, wherein the auxiliary helical section has a diameter smaller than that of the helical section.

4. The developing device according to claim 1, further comprising:

an extended roof section that is provided above the auxiliary helical section in the gravitational direction, the extended roof section having a lower surface located lower than a step in the gravitational direction and being extended from the step.

5. The developing device according to claim 1, further comprising:

a pressure applier that is provided above the reverse helical section in the gravitational direction, the pressure applier being configured to apply pressure to the developer transported in the reverse direction by the reverse helical section.

6. The developing device according to claim 5, wherein the reverse helical section has a diameter smaller than that of the helical section.

7. The developing device according to claim 1, wherein the ejection path is configured to receive the excess developer via the second transport path.

8. The developing device according to claim 7, wherein the ejection path is provided on the side of the support, that is upstream from the support in the reverse direction.

9. An image forming apparatus comprising:

a developing device; and a developer bearing member configured to retain a developer developed by the developing device, wherein the developing device includes:

a first transport member and a second transport member that are disposed, respectively, in a first transport path and a second transport path provided at an upper side and a lower side in a gravitational direction and that are configured to transport the developer so as to cause the developer to circulate between the first transport path and the second transport path;

an ejecting path that is provided in the first transport path, wherein the ejecting path is disposed at the upper side in the gravitational direction and is configured to eject an excess developer; and a reverse helical section that is disposed on a side of a support that supports the second transport member, the reverse helical section helically extending in a reverse direction relative to a helical section provided for circulating the developer, and the side of the support being upstream from the support in the reverse direction, wherein the reverse helical section is disposed in the second transport path, wherein the reverse helical section is configured to transport the developer to the ejecting path, wherein the developing device further comprises an auxiliary helical section that is provided between the support and the reverse helical section, the auxiliary helical section helically extending in a helical direction identical to that of the reverse helical section, and wherein the auxiliary helical section has a diameter smaller than that of the reverse helical section.

* * * * *